US005115944A

United States Patent [19]

Nikolich

[11] Patent Number: 5,115,944

[45] Date of Patent: May 26, 1992

[54] FLUID DISPENSER HAVING A COLLAPSIBLE INNER BAG

[75] Inventor: Milovan A. Nikolich, Wilmette, Ill.

[73] Assignee: Illinois Tool Works Inc., Glenview, Ill.

[21] Appl. No.: 567,069

[22] Filed: Aug. 14, 1990

[51] Int. Cl.[5] ..... B65D 35/00

[52] U.S. Cl. ..... 222/94; 222/95; 222/105; 222/389

[58] Field of Search ..... 222/389, 386.5, 105, 222/95, 94

[56] References Cited

U.S. PATENT DOCUMENTS

| | | | |
|---|---|---|---|
| 4,189,069 | 2/1980 | Stoody | 222/105 X |
| 4,222,499 | 9/1980 | Lee et al. | 222/386.5 X |
| 4,458,830 | 7/1984 | Werding | 222/386.5 X |
| 4,964,540 | 10/1990 | Katz | 222/105 X |

FOREIGN PATENT DOCUMENTS

| | | | |
|---|---|---|---|
| 480864 | 8/1976 | Australia | 222/105 |
| 0354137 | 2/1990 | European Pat. Off. | 222/389 |
| 2233843 | 1/1975 | France | 222/386.5 |
| 8200780 | 3/1982 | World Int. Prop. O. | 222/386.5 |

*Primary Examiner*—Kevin P. Shaver
*Assistant Examiner*—Anthoula Pomrening
*Attorney, Agent, or Firm*—Schwartz & Weinrieb

[57] ABSTRACT

A dispenser for a dispensable fluid, such as, for example, a hydrocarbon fuel, is of the type comprising an outer canister containing a pressurized propellant, an inner bag containing the dispensable fluid, and a normally closed valve. The inner bag has a flexible wall with an orifice having a margin. Two clamping members, which may be snap-fitted to each other, clamp the valve to the inner bag at the margin of the orifice. A resilient washer is disposed outside the inner bag, in intimate contact between one of the clamping members and the margin of the orifice, so as to form a fluid-tight seal around the orifice.

13 Claims, 2 Drawing Sheets

FLUID DISPENSER HAVING A COLLAPSIBLE INNER BAG

TECHNICAL FIELD OF THE INVENTION

This invention relates to improvements in a dispenser for a dispensable fluid, such as, for example, a hydrocarbon fuel, which is of the type comprising an outer canister containing a pressurized propellant, an inner bag containing the dispensable fluid, and a normally closed valve enabling the dispensable fluid to be controllably dispensed from the inner bag. This invention provides that the inner bag is clamped to the normally closed valve.

BACKGROUND OF THE INVENTION

As exemplified in Nikolich U.S. Pat. Nos. 4,403,722, 4,483,474, and 4,522,162, it is known to use a dispenser of the type noted above to dispense a hydrocarbon fuel to a combustion gas-powered tool, such as, for example, a combustion gas-powered fastener-driving tool. Such fastener-driving tools and such fuel dispensers therefor are available commercially from ITW-Paslode (a division of Illinois Tool Works Inc.) of Lincolnshire, Illinois, under its IMPULSE TM trademark.

Typically, the inner bag of such a dispenser is made from a flexible, laminated, multi-layer sheet. The sheet may have an outermost layer of nylon film, an intermediate layer of aluminum foil, and an innermost layer of polyethylene film with suitable bonding layers between the aluminum and other layers. The polyethylene layer, which before heat-sealing is oriented, can be heat-sealed to itself.

Typically, moreover, the valve assembly includes a tubular part, which is molded from polyethylene, and which extends into the inner bag. It is known for the inner bag to be heat-sealed, at one of its seams, around and to such a part.

However, if the dispensable fluid is a hydrocarbon fuel, special sealing problems arise whereupon it may not be entirely satisfactory for the inner bag to be heat-sealed, at one of its seams, around and to such a part. A better way to mount the inner bag is required, particularly but not exclusively if the dispensable fluid is a hydrocarbon fuel.

OBJECT OF THE INVENTION

Accordingly, this invention is addressed to improvements in a fluid dispenser of the type noted above, and particularly but not exclusively to a dispenser for a hydrocarbon fuel.

SUMMARY OF THE INVENTION

This invention provides improvements in a dispenser for a dispensable fluid, which may be a hydrocarbon fuel or another similar or dissimilar fluid, which is of the type comprising an outer canister having an open end or mouth and containing a pressurized propellant, an inner bag disposed within the outer canister, and a valve assembly closing the mouth of the outer canister and communicating with the inner bag.

When the valve is closed, the valve assembly enables the inner bag to contain the dispensable fluid. When the valve is opened, the valve assembly enables the pressurized propellant to collapse the inner bag in such a manner that the dispensable fluid is dispensed from the inner bag through means of the valve.

The inner bag has a flexible wall with at least one heat-sealed seam and with an orifice having a margin spaced from the at least one seam. The inner bag is sealed so as to be substantially impervious to the dispensable fluid, except at the orifice, which is used to charge the inner bag with the dispensable fluid and to permit discharge of the dispensable fluid from the inner bag.

It is contemplated by means of this invention that the valve assembly includes structure for clamping the valve to the flexible wall of the inner bag at the margin of the orifice and for forming a substantially fluid-tight seal around the orifice.

Preferably, the valve assembly includes two clamping members which are mechanically connected to each other in such manner that the valve is clamped to the flexible sheet used to make the inner bag at the margin of the orifice. One such clamping member is disposed at least partly inside the inner bag. The other clamping member is disposed at least partly outside the inner bag. The latter clamping member is structurally connected to the valve. It is preferred that a resilient washer is disposed in intimate contact between one of the clamping members and the margin of the orifice, preferably between the latter clamping member and the margin of the orifice, so as to form a substantially fluid-tight seal around the orifice.

One of the clamping members may have a tubular portion extending through the orifice, whereupon it also may have an annular portion integral with the tubular portion, and whereupon further the other clamping member may have an annular portion disposed around the tubular portion. The resilient washer may then be disposed between the annular portion of one of the clamping members and the margin of the orifice.

Preferably, the annular portion of the clamping member having the tubular portion is disposed inside the inner bag, and the annular portion of the other clamping member is disposed outside the inner bag and is structurally connected to the valve. It is preferred that the resilient washer then be disposed between the latter annular portion, which is disposed outside the inner bag, and the margin of the orifice.

It is preferred that the clamping members are adapted to be snap-fitted with respect to each other. It is contemplated by means of this invention, however, that the clamping members may be threadably connected to each other or may be mechanically connected in some other manner to each other.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein.

DETAILED DESCRIPTION OF PREFERRED EMBODIMENT

Figure 1:
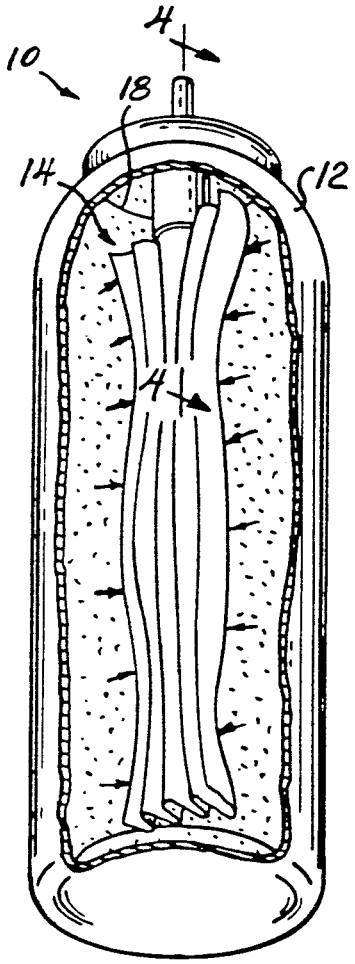
FIG. 1 is a perspective view partly cut-away, of a fluid dispenser constituting a preferred embodiment of this invention and comprising an outer container, an inner bag formed from a laminated sheet, and a valve assembly. The inner bag is shown in an empty condition.
Figure 2:
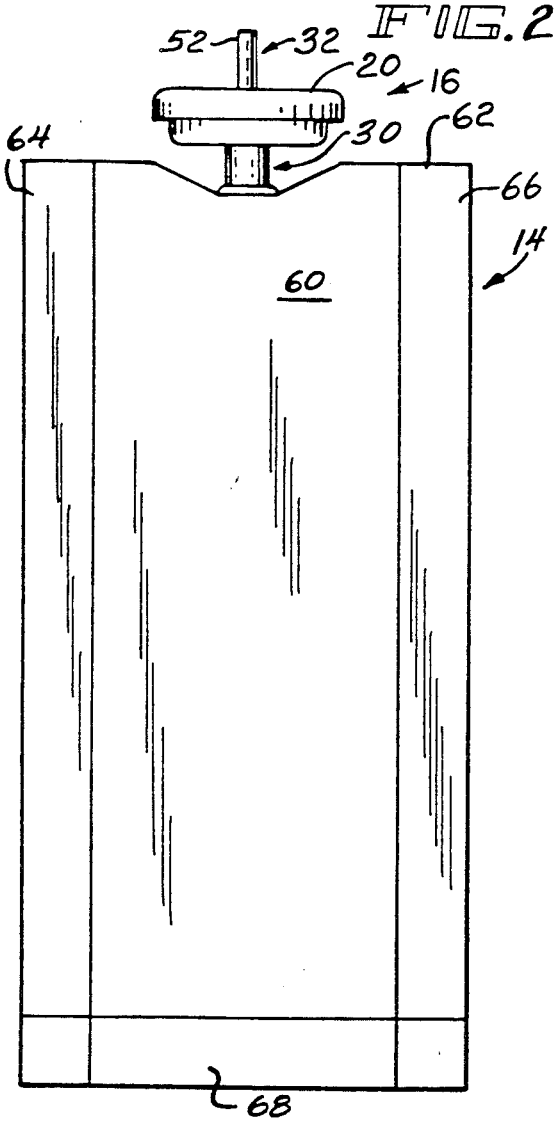
FIG. 2 is an elevational view of the inner bag and the valve assembly, apart from the outer container, with the inner bag shown in a flattened, empty condition.
Figure 3:
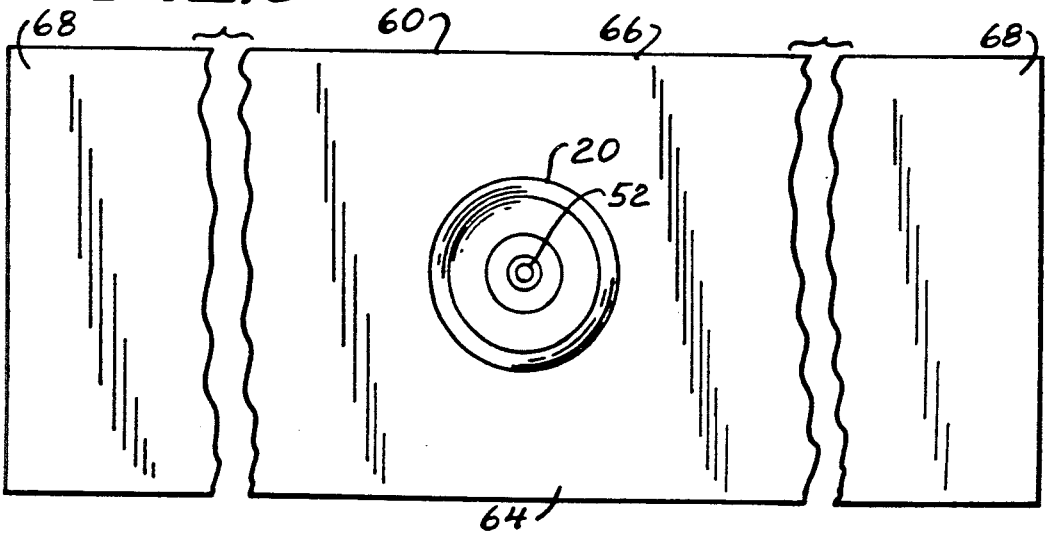
FIG. 3 is a plan view of the sheet used to form the inner bag and the valve assembly, apart from the outer container, and before the inner bag is formed.
Figure 4:
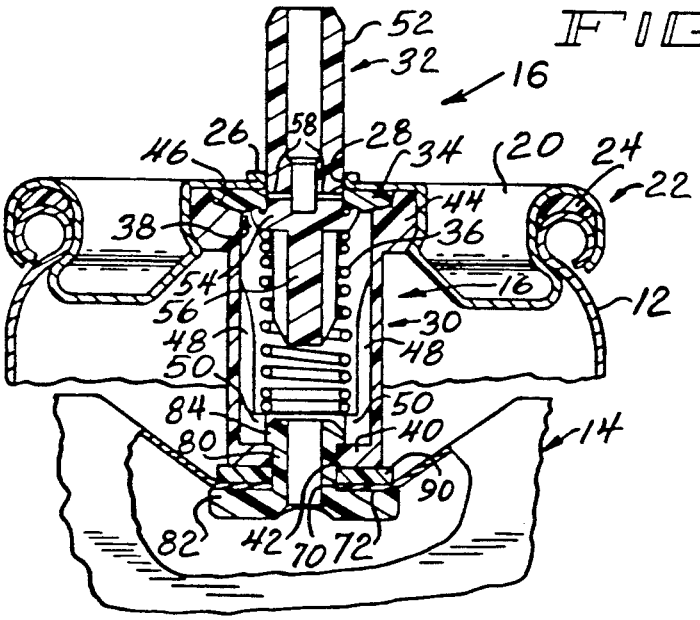
FIG. 4 is a fragmentary, sectional view taken along line 4—4 of FIG. 1, in a direction indicated by means of the arrows, with the valve assembly shown in a normal, closed condition.
Figure 5:
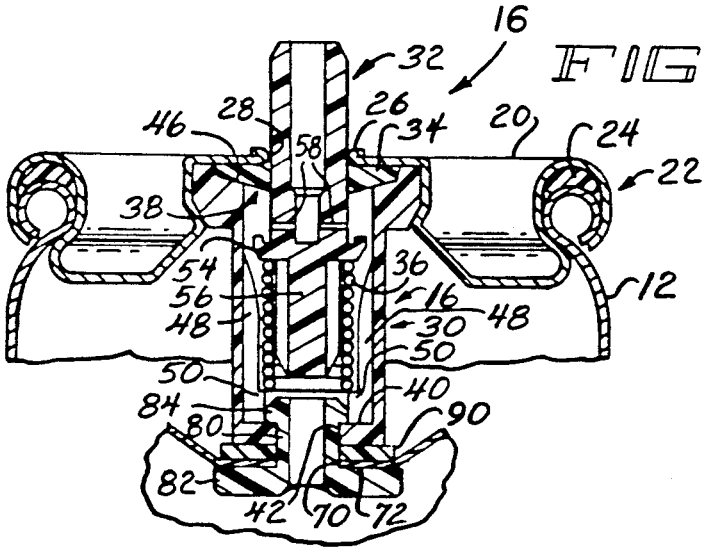
FIG. 5 is a fragmentary, sectional view similar to FIG. 4, but with the valve assembly shown in a changed, opened condition.

A preferred embodiment of this invention is illustrated in the drawings and is to be hereinafter described. It should be here understood that the illustrated embodiment is exemplary and that this invention is not limited to such an embodiment.

As shown in FIG. 1, a dispenser 10 for a dispensable fluid, such, for example, a hydrocarbon fuel, constitutes a preferred embodiment of this invention.

i The dispenser 10 may be advantageously employed in a combustion gas-powered fastener-driving tool, such as, for example, the exemplified in the Nikolich patents noted above. The dispenser 10 may be alternatively employed in any one of a wide variety of similar and dissimilar applications tools, equipment, devices, or the like.

Broadly, the dispenser 10 comprises an outer canister 12, an inner bag 14, and a valve assembly 16. The outer canister 12 may be conventionally made by means of a deep-drawing process or otherwise from aluminum, which is preferred, or steel. The valve assembly 16 closes an upper mouth 18 of the outer canister 12 and supports the inner bag 14 within the outer canister 12 so that the outer canister 12 is adapted to contain a pressurized propellant, such as, for example, propane or carbon dioxide, which tends to collapse the inner bag 14.

The valve assembly 16 includes a cover 20, which may be conventionally made from the metal used for the outer canister 12. The cover 20 is connected in a known manner to the outer canister 12, at a rolled seam 22 defining the upper mouth 18 and incorporating a resilient gasket 24. The resilient gasket 24 causes the rolled seam 22 to be substantially fluid-tight. An elastomeric material tending to be substantially impervious to the pressurized propellant is used for the resilient gasket 24, BUNA N synthetic rubber being preferred. The cover 20 has a rolled edge 26 defining a central aperture 28.

Moreover, the valve assembly 16 includes a tubular valve body 30, a valve stem 32, a resilient washer 34, and a coiled spring 36, which are assembled so as to provide a normally closed valve 38. The tubular valve body 30 and the valve stem 32 may be advantageously molded from a suitable polymer, such as, for example, polyethylene, which is preferred.

The tubular valve body 30 is molded so as to have, at its lower end, an annular flange 40 extending inwardly in a radial sense and defining a central orifice 42, and so as to have, at its upper end, an annular boss 44 extending outwardly in a radial sense and upwardly and defining an annular recess 46. Moreover, the tubular valve body 30 is molded so as to have, along its inner wall, axially extending ribs 48, each terminating in a lower step 50 extending inwardly in a radial sense. Two such ribs 48 are shown, in diametric opposition to each other. Additional ribs 48 may be optionally provided, in circumferentially spaced relation with respect to one another.

The resilient washer 34 fits into the annular recess 46 and is retained therein by means of the cover 20, which partly overlies the resilient washer 34, and which is rolled partly under the annular boss 44. As retained therein, the resilient washer 34 is compressed slightly near its outer edge. An elastomeric material tending to be substantially impervious to the hydrocarbon fuel or other dispensable fluid is used for the resilient washer 34, BUNA N synthetic rubber being preferred.

The valve stem 32, which defines an axis, has an upper, tubular portion 52, an intermediate, annular portion 54, and a lower, rod-like portion 56. The upper, tubular portion 52 extends through the resilient washer 34 and through the central aperture 28 of the cover 20, with sufficient clearance to permit axial movement of the upper, tubular portion 52 relative to the resilient washer 34 and relative to the cover 20. The upper tubular portion 52 has a pair of radial, small diameter, oppositely extending passageways 58.

The coiled spring 36 is disposed around the lower, rod-like portion 56, so as to be axially compressed between the intermediate, annular portion 54 and the lower steps 50 of the axially extending ribs 48 of the valve body 3. Thus, the coiled spring 36 biases the valve stem 32 upwardly, so as to press the intermediate, annular portion 54 upwardly against the resilient washer 34.

Therefore, when the intermediate, annular portion 54 is pressed upwardly against the resilient washer 34, the passageways 58 are closed at their radially outer ends by means of the resilient washer 34, whereby the valve 38 is closed. However, when the valve stem 32 is pressed downwardly, so as to separate the intermediate, annular portion 54 from the resilient washer 34, the passageways 58 are moved to position beneath the resilient washer 34, whereby the valve 38 is respectively opened. The valve stem 32 may be pressed downwardly in a known manner, by means of an actuator (not shown) included within this combustion gas-powered fastener-driving tool, as discussed above.

The inner bag 14 is similar to known bags for fluid dispensers in that the same may be made from a single, flexible, laminated sheet 60. The sheet 60 has an outermost layer of nylon film, an intermediate layer of aluminum foil, and an innermost layer of polyethylene film with bonding layers of ethylene vinyl acetate interposed between the aluminum and other layers. The polyethylene layer, which before heat-sealing is oriented, can be heat-sealed to itself.

The inner bag 14 is different from known bags for fluid dispensers in being folded, not heat-sealed, along an upper edge 62. The inner bag 14 is heat-sealed, in a known manner, along two lateral edges 64, 66, and along a bottom edge 68.

Moreover, the inner bag 14 is different from known bags for fluid dispensers in that the same is provided with a circular orifice 70, where the sheet 60 is folded along the upper edge 62. The orifice 70 has a margin 72 which is spaced from the lateral edges 64, 66, approximately half-way between such edges. The inner bag 14 is heat-sealed so as to be substantially impervious to the hydrocarbon fuel or other dispensable fluid, except at the orifice 70, which is used, by means of the valve 38, to charge the inner bag 14 with the dispensable fluid and to discharge the dispensable fluid from the inner bag 14.

The valve assembly 16 includes two clamping members, which are mechanically connected to each other in such a manner that the valve 38 is clamped to the flexible sheet 60 at the margin 72 of the orifice 70. The annular flange 40 of the tubular valve body 30 and a tubular clamping member 80 to be next described constitute the clamping members.

At its respective ends, the tubular clamping member 80 has an annular flange 82 and an annular boss 84. Before the inner bag 14 is heat-sealed at all of its lateral and bottom edges, the tubular clamping member 80 is passed through the orifice 70 in such a manner that, when the inner bag 14 is heat-sealed at its noted portions, the annular flange 82 is disposed within the inner bag 14. A resilient washer 90 is disposed around the tubular clamping member 80, outside the inner bag 14, in intimate contact with the margin 72 of the orifice 70. An elastomeric material tending to be substantially impervious to the hydrocarbon fuel or other dispensable fluid is used for the resilient washer 90, BUNA N synthetic rubber being preferred.

It is contemplated by means of this invention that the resilient washer 90 may be alternatively disposed around the tubular clamping member 80, inside the inner bag 14, in intimate contact between the annular flange 82 and the margin 72 of the orifice 70. Also, it is contemplated by means of this invention that the tubular clamping member 80 may be axially longer, that the resilient washer 90 may be thus disposed around the tubular clamping member 80, outside the inner bag 14, in intimate contact with the margin 72 of the orifice 70, and that a similar washer (not shown) may also be disposed around the tubular clamping member 80, inside the inner bag 14, in intimate contact between the annular flange 82 and the margin 72 of the orifice 70.

The tubular clamping member 80 with the resilient washer 90 disposed around it, outside the inner bag 14, is pushed through the orifice 42 of the annular flange 40 in such a manner that the annular boss 84 snaps over the annular flange 40. As mentioned above, the tubular valve body 30 is molded from a polymeric material, such as, for example, polyethylene. The tubular element 80 is molded from a similar material. Such a material has sufficient resiliency and the tubular clamping member 80 and the tubular valve body 30 have suitable shapes so as to adapt the tubular clamping member 80 and the tubular valve body 30 to be snap-fitted with respect to each other.

Thus, a snap-fitted, mechanical connection is formed between the tubular element 80 and the annular flange 40. Also, it is contemplated by means of this invention that a threaded, mechanical connection may be alternatively formed between male threads (not shown) formed upon the tubular element 80 and female threads (not shown) formed upon the annular flange 40.

Figure 6:
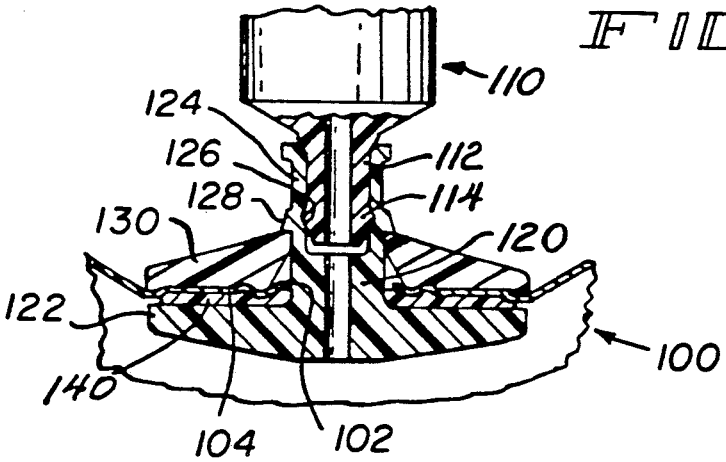
FIG. 6 is a fragmentary sectional view analogous to FIGS. 4 and 5 but showing an alternate embodiment of this invention.

As shown in FIG. 6, an alternate embodiment is similar to the preferred embodiment shown in FIGS. 1 through 5, except as noted herein. The alternate embodiment utilizes an inner bag 100, which is similar to the inner bag 14, except that the orifice 102 of the inner bag 100 is larger than the orifice 70 of the inner bag 14. The orifice 102 has a margin 104 analogous to the margin 72 of the orifice 70.

In the alternate embodiment, a tubular valve body 110 is similar to the tubular valve body 30, except that the tubular valve body 110 is formed integrally with a tubular nipple 112 extending downwardly. At its lower end, the tubular nipple 112 has an annular boss 114. At its respective ends, a tubular clamping member 120, which is analogous to the tubular clamping member 80, has an annular flange 122 and an annular boss 124. The annular clamping member 120 has an internal, annular groove 126 and an external, annular boss 128. A clamping ring 130 is provided, which has no counterpart in the preferred embodiment. A resilient washer 140 is provided, which is analogous to the resilient washer 90.

The tubular clamping member 120 with the resilient washer 140 disposed around it, inside the inner bag 100, is pushed through the orifice 102, whereupon the clamping ring 130 is snapped over the tubular clamping member 120, between the annular boss 128 and the margin 104 of the orifice 102. Thus, the resilient washer 140 is compressed slightly, between the clamping ring 130 and the annular flange 122 of the tubular clamping member 120.

Thereupon, the tubular clamping member 120 is telescoped over the tubular nipple 112 until the annular boss 114 snaps into the annular groove 126, so as to form a mechanical connection between the tubular nipple 112 and the tubular clamping member 120, to which the inner bag 100 is clamped by means of the clamping ring 130 and the resilient washer 140.

Various modifications may be made to either of the described embodiments without departing from the scope and spirit of this invention which is set forth in the appended claims. It is therefore to be understood that within the scope of the appended claims, the present invention may be practiced otherwise than as specifically described herein.

I claim:

1. A dispenser for a dispensable fluid, comprising:

an outer canister having a mouth and containing a pressurized propellant;

an inner bag disposed within said outer canister; and valve assembly means including a normally closed valve closing said mouth of said outer canister and communicating with said inner bag for enabling said inner bag to retain said dispensable fluid therein when said valve is at a closed position and for enabling said pressurized propellant to collapse said inner bag in such a manner that said dispensable fluid is propelled from said inner bag through said valve when said valve is at an opened position;

said inner bag comprising a flexible wall with an orifice having a margin defined around said orifice, said inner bag being entirely sealed except at said orifice; and said valve assembly means including first and second portions mechanically engaged directly with each other and clamping said margin of said inner bag therebetween by engaging inner and outer surface portions of said margin of said inner bag at an axial position of said valve assembly means which is axially remote from said valve of said valve assembly means so as to secure said valve to said flexible wall of said inner bag at said margin of said inner bag flexible wall surrounding said orifice and for forming a substantially fluid-tight seal around said orifice.

2. A dispenser as set forth in claim 1, further comprising:

cover means having an outer peripheral portion thereof fixedly mounted upon said outer canister;

recess means defined within said cover means; and a valve body, within which said valve is reciprocably movable between said opened and closed positions, fixedly mounted within said recess means of said cover means.

3. A dispenser for a dispensable fluid, comprising:

an outer canister having a mouth and containing a pressurized propellant;

an inner bag disposed with said outer canister; and valve assembly means including a normally closed valve closing said mouth of said outer canister and communicating with said inner bag for enabling said inner bag to retain said dispensable fluid when said valve is closed at a position and for enabling said pressurized propellant to collapse said inner bag in such a manner that said dispensable fluid is propelled from said inner bag through said valve when said valve is at an opened position;

said inner bag comprising a flexible wall with an orifice having a margin defined around said orifice, said inner bag being entirely sealed except at said orifice; and said valve assembly means including two clamping components mechanically engaged directly with each other in such a manner that said valve assembly means is clamped to said flexible wall of said inner bag at said margin of said orifice at an axial position of said valve assembly means which is axially remote from said valve of said valve assembly means so as to secure said valve to said flexible wall of said inner bag at said margin of said inner bag flexible wall surrounding said orifice, namely, a first clamping component disposed at least partly inside said inner bag and engaging an inner surface portion of said margin of said inner bag flexible wall surrounding said orifice, and a second clamping component disposed at least partly outside said inner bag and engaging an outer surface portion of said margin of said inner bag flexible wall surrounding said orifice, said valve assembly means thereby forming a substantially fluid-tight seal around said orifice.

4. The dispenser of claim 3 wherein one of the clamping components has a tubular portion extending through the orifice.

5. The dispenser of claim 4 wherein a resilient gasket is disposed around the tubular portion.

6. The dispenser of claim 5 wherein the clamping components having the tubular portion has an annular portion integral with the tubular portion and wherein the other clamping component has an annular portion disposed around the tubular portion of said one of said clamping components.

7. The dispenser of claim 6 wherein said resilient washer is disposed between the annular portion of said one of the clamping component and the margin of the orifice.

8. The dispenser of claim 6 wherein the annular portion of the clamping component having the tubular portion is disposed inside the inner bag and wherein the annular portion of the other clamping component is disposed outside the inner bag.

9. The dispenser of claim 8 wherein said resilient washer is disposed between the annular portion disposed outside the inner bag and the margin of the orifice.

10. The dispenser of claim 3 wherein the first and second clamping components are adapted to be snap-fitted to each other.

11. The dispenser of claim 10 wherein one of the clamping components has a tubular portion extending through the orifice and an annular portion integral with the tubular portion, wherein the other clamping component has an annular portion disposed around the tubular portion of said one of said clamping components and wherein a resilient washer is disposed between the annular portion of one of the clamping components and the margin of the orifice.

12. The dispenser of claim 11 wherein the annular portion of the clamping components having the tubular portion is disposed inside the inner bag and wherein the annular portion of the other clamping components is disposed outside the inner bag.

13. A dispenser as set forth in claim 3, further comprising:

cover means having an outer peripheral portion thereof fixedly mounted upon said outer canister;

recess means defined within said cover means; and a valve body, within which said valve is reciprocably movable between said opened and closed positions, fixedly mounted within said recess means of said cover means.

* * * * *